US006885179B1

(12) United States Patent
Ker et al.

(10) Patent No.: US 6,885,179 B1
(45) Date of Patent: Apr. 26, 2005

(54) LOW-VOLTAGE BANDGAP REFERENCE

(75) Inventors: Ming-Dou Ker, Hsin-Chu (TW); Ching-Yun Chu, Hsin-Chu (TW); Wen-Yu Lo, Tai-Chung Hsien (TW)

(73) Assignee: Silicon Integrated Systems Corp., Hsin-Chu (TW)

( * ) Notice: Subject to any disclaimer, the term of this patent is extended or adjusted under 35 U.S.C. 154(b) by 0 days.

(21) Appl. No.: 10/708,223

(22) Filed: Feb. 17, 2004

(51) Int. Cl.[7] ..... G05F 3/16
(52) U.S. Cl. ..... 323/316
(58) Field of Search ..... 323/316, 315, 323/317, 313, 907; 327/538, 539

(56) References Cited

U.S. PATENT DOCUMENTS 4,924,113 A * 5/1990 Schade, Jr. ..... 323/316
5,666,046 A * 9/1997 Mietus ..... 323/313

OTHER PUBLICATIONS

H. Neuteboom, B.M. J. Kup, M. Janssens; A DSP–based hearing instrument IC; IEEE Journal of Solid–State Circuits, Nov. 1997; p. 1790–p. 1806; vol. 32.

H. Banba, H. Shiga, A. Umezawa, T. Miyaba, T. Tanzawa, S. Atsumi, K. Sakui; A CMOS bandgap reference circuit with sub 1–V operation; IEEE Journal of Solid–State Circuits; May 1999; p. 670–p. 674; vol. 34.

G. Giustolisi; A Low–Voltage Low–Power Voltage Reference Based on Subthreshold MOSFETs; IEEE Journal of Solid–State Circuits; Jan. 2003, p. 151–p. 154; vol. 38, No. 1.

P. Malcovati, F. Maloberti, M. Pruzzi, C. Fiocchi; Curvature compensated BICMOS bandgap with 1–V supply voltage; IEEE Journal of Solid–State Circuits; Jul. 2001; p. 52–p. 55; vol. 36, No. 7.

Yueming Jiang, Edward K.F. Lee; A 1.2 V bandgap reference based on transimpedance amplifier; ISCAS 2000–IEEE international symposium on Circuits and Systems; May 23–31, 2000; p. 261–p. 264.

Shu–Yuan Chin, Chung–Yu Wu, A New Type of Curvature–Compensated CMOS Bandgap Voltage Reference; VLSITSA; 1991; p. 398–p. 402.

Ka Nang Leung, IEEE, Philip K. T. Mok; A Sub–1–V 15–ppm/•C CMOS Bandgap Voltage Reference without Requiring Low Threshold Voltage Device; IEEE Journal of Solid–State Circuits; Apr. 2002; p. 526–p. 530; vol. 37, No. 4.

* cited by examiner

*Primary Examiner*—Shawn Riley
(74) *Attorney, Agent, or Firm*—Winston Hsu

(57) ABSTRACT

Voltage dividing resistors (R1*a*, R1*b*, R2*a*, R2*b*) are connected in parallel with diode connected bipolar transistors (Q1, Q2) for splitting the voltage to the inputs of an operational amplifier (62, 82). Current is provided to this arrangement by current sources (I1, I2). When the supply voltage is about 0.85 volts, a temperature insensitive reference voltage of about 200 millivolts is available at the drain of a second transistor (M2, M2).

15 Claims, 11 Drawing Sheets

LOW-VOLTAGE BANDGAP REFERENCE

BACKGROUND OF INVENTION

1. Field of the Invention

The present invention relates to a voltage reference circuit with low sensitivity to temperature, and more specifically, to a low-voltage bandgap reference circuit.

2. Description of the Prior Art

Reference voltage generators are widely used in both analog and digital circuits such as DRAM and flash memories. A bandgap reference (also termed BGR) is a circuit that provides a stable output voltage with low sensitivity to temperature and supply voltage.

A conventional bandgap reference output is about 1.25 V, which is almost equal to the silicon energy gap measured in electron volts. However, in modern deep-submicron technology, a voltage of around 1 V is preferred. As such, the conventional bandgap reference is inadequate for current requirements.

The 1 V minimum supply voltage is constrained by two factors. First, the reference voltage of about 1.25 V exceeds 1 V. Second, low voltage design of proportional-to-absolute-temperature (PTAT) current generation loops is limited by the input common-mode voltage of the amplifier. The effects of these constraints can be reduced by resistive subdivision methods and by using low threshold voltage devices or BiCMOS processes. However, both of these solutions require costly special process technology.

Bandgap references can be divided into two groups: type-A and type-B. Type-A bandgap references sum voltages of two elements having opposite temperature components. Type-B bandgap references combine the currents of two elements. Both type A and type B bandgap references can be designed to function with a normal supply voltage of greater than 1 V and a sub-1-V supply voltage.

FIG. 1 illustrates a conventional type-A bandgap reference circuit 10. The bandgap reference circuit 10 includes an operational amplifier 12, two transistors M1 and M2, two resistors R1 and R2, and two diodes Q1 and Q2. The sources of the transistors M1, M2 are connected to a supply voltage $V_{DD}$. The drain of the transistor M1 is connected to the emitter of the diode Q1 through the resistor R1 and to the positive input of the amplifier 12. Similarly, the drain of the transistor M2 is connected to the emitter of the diode Q2 through the resistor R2 and to the negative input of the amplifier 12. The gates of the transistors M1, M2 are connected to the output of the amplifier 12. In CMOS applications, each diode Q1, Q2 is formed with a parasitic vertical bipolar transistor having a collector and base connected to ground.

Neglecting base current, the emitter-base voltage of a forward active operation diode can be expressed as:

$$V_{EB} = \frac{kT}{q}\ln\left(\frac{I_c}{I_s}\right), \tag{1}$$

where:

k is Boltzmanns constant ($1.38\times10^{-23}$J/K), q is the electronic charge ($1.6\times10^{-19}$C), T is temperature, $I_C$ is the collector current, and $I_S$ is the saturation current.

When the input voltages of the amplifier 12 are forced to be the same, and the size of the diode Q1 is N times that of the diode Q2, the emitter-base voltage difference between diodes Q1 and Q2, $\Delta V_{EB}$, becomes:

$$\Delta V_{EB} = V_{EB2} - V_{EB1} = \frac{kT}{q}\ln N, \tag{2}$$

where:

$V_{EB1}$ is the emitter-base voltage of diode Q1, and $V_{EB2}$ is the emitter-base voltage of diode Q2.

Finally, when the current through resistor R1 is equal to the current through resistor R2 and is set to be PTAT, an output reference voltage, $V_{REF}$, can be obtained by:

$$V_{REF} = V_{EB2} + \frac{R_2}{R_1}\Delta V_{EB} \equiv V_{REF-CONV}, \tag{3}$$

where:

$R_1$ is the resistance of resistor R1, $R_2$ is the resistance of resistor R2, and $V_{REF-CONV}$ is the reference voltage (conventional).

The emitter-base voltage, $V_{EB}$, has a negative temperature coefficient of −2 mV/° C., while the emitter-base voltage difference, $\Delta V_{EB}$, has a positive temperature coefficient of 0.085 mV/° C. Hence, if a proper ratio of resistances of resistors R1 and R2 is selected, the output reference voltage, $V_{REF}$, will have low sensitivity to temperature. In general, the supply voltage, $V_{DD}$, is set to about 3–5 V and the output reference voltage, $V_{REF}$, is about 1.25 V, as the conventional bandgap circuit 10 cannot be used at a lower voltage such as 1 V.

FIG. 2 illustrates a conventional type-B bandgap reference circuit 20. Elements in FIG. 2 having the same reference numbers of those in FIG. 1 are the same. The bandgap reference circuit 20 includes an operational amplifier 22; three transistors M1, M2, and M3; four resistors R1, R2, R3, and R4; and two diodes Q1 and Q2 interconnected as illustrated in FIG. 2.

Compared with the type-A circuit 10, the type-B circuit 20 is more suitable for operating with a low supply voltage. Instead of stacking two complementary voltages, the type-B bandgap reference 20 adds two currents with opposite temperature dependencies. In the bandgap reference of FIG. 2, the current through the resistor R3 is PTAT. If the resistances of the resistors R1 and R2 are equal, then the current through the MOS transistor M3 mirrored from transistors M1 and M2 can be expressed as:

$$I_{M3} = \frac{1}{R_1}\left(V_{EB2} + \frac{R_1}{R_3}\frac{kT}{q}\ln N\right), \tag{4}$$

with the reference voltage being expressed as:

$$V_{REF} = \frac{R_4}{R_1}\left(V_{EB2} + \frac{R_1}{R_3}\frac{kT}{q}\ln N\right) = \frac{R_4}{R_1}\cdot V_{REF-CONV} \tag{5}$$

Thus, in the bandgap reference circuit 20 of FIG. 2, as ratios of resistances are key, the variations in individual resistances due to process conditions does not greatly affect the reference voltage. In general, the supply voltage, $V_{DD}$, is set to about 1.5 V and the output reference voltage, $V_{REF}$, is about 1.2 V.

FIG. 3 illustrates a conventional type-B bandgap reference circuit 30 capable of sub-1-V operation. Elements in FIG. 3 having the same reference numbers of those in FIG.

2 are the same. The bandgap reference circuit 30 includes an operational amplifier 32; three transistors M1, M2, and M3; six resistors R1*a*, R1*b*, R2*a*, R2*b*, R3, and R4; and two diodes Q1 and Q2 interconnected as illustrated in FIG. 3. The supply voltage is limited by the input common-mode voltage of the amplifier 32, which must be low enough to ensure that the input pair operate in the saturation region.

The improvement of low supply voltage realized with the bandgap reference circuit 30 is based on the positions of the input pair of the operational amplifier 32. The established feedback loop produces a PTAT voltage across the resistor R3. The resistance ratio of the resistors R1*a* and R2*a* causes the voltage between the supply voltage and the input common voltage of the operational amplifier 32 to become increased. This makes the p-channel input pair operate in the saturation region even when the supply voltage is under 1V. The sub-1-V reference voltage output by the circuit 30 can be expressed as:

$$V_{REF-SUBIV} = \frac{R_4}{R_1}\left(V_{EB2} + \frac{R_1}{R_3}\frac{kT}{q}\ln N\right) = \frac{R_4}{R_1}\cdot V_{REF-CONV}, \quad (6)$$

which is similar to the circuit 20 of FIG. 2. During operation of the circuit 30, the supply voltage, $V_{DD}$, is set to about 1.0–1.9 V and the output reference voltage, $V_{REF}$, is about 0.6 V.

Given the state-of-the-art bandgap reference circuits 10, 20, and 30 described above, it is clear that an improved and inexpensive low-voltage bandgap reference circuit is required.

SUMMARY OF INVENTION

It is therefore a primary objective of the claimed invention to provide a low-voltage bandgap reference circuit having low sensitively to temperature.

Briefly summarized, the claimed invention includes an operational amplifier, a first transistor having a source connected to a first voltage and a drain connected to a positive input end of the operational amplifier and separately to a first node through a first resistor, a second transistor having a source connected to the first voltage and a drain connected to a second node through a second resistor, the second node being connected to the negative input end of the operational amplifier, and a gate of the second transistor being connected to a gate of the first transistor and the output of the operational amplifier. The claimed invention further includes a third resistor and a fourth resistor connected in series at the first node, the third and fourth resistors connected in parallel with a first diode between a first current source and a second voltage; and a fifth resistor and a sixth resistor connected in series at the second node, the fifth and sixth resistors connected in parallel with a second diode between a second current source and the second voltage.

It is an advantage of the claimed invention that a temperature insensitive reference voltage of less than 1 volt can be obtained at the drain of the second transistor when the first voltage is set appropriately relative to the second voltage.

It is a further advantage of the claimed invention that the bandgap reference circuit is compatible with established CMOS technology.

It is a further advantage of the claimed invention that no low-threshold voltage or BiCMOS devices are required.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
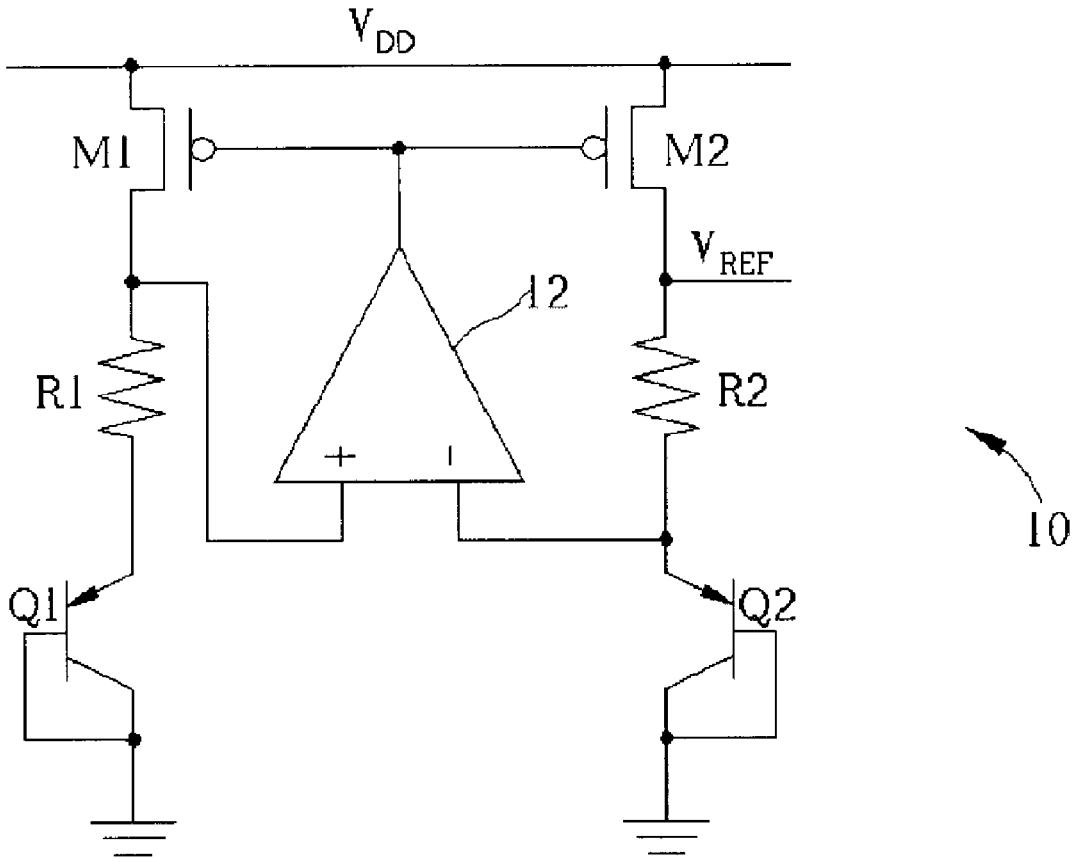
Fig. 1 Prior art
FIG. 1 is a circuit diagram of a conventional bandgap reference.
Figure 2:
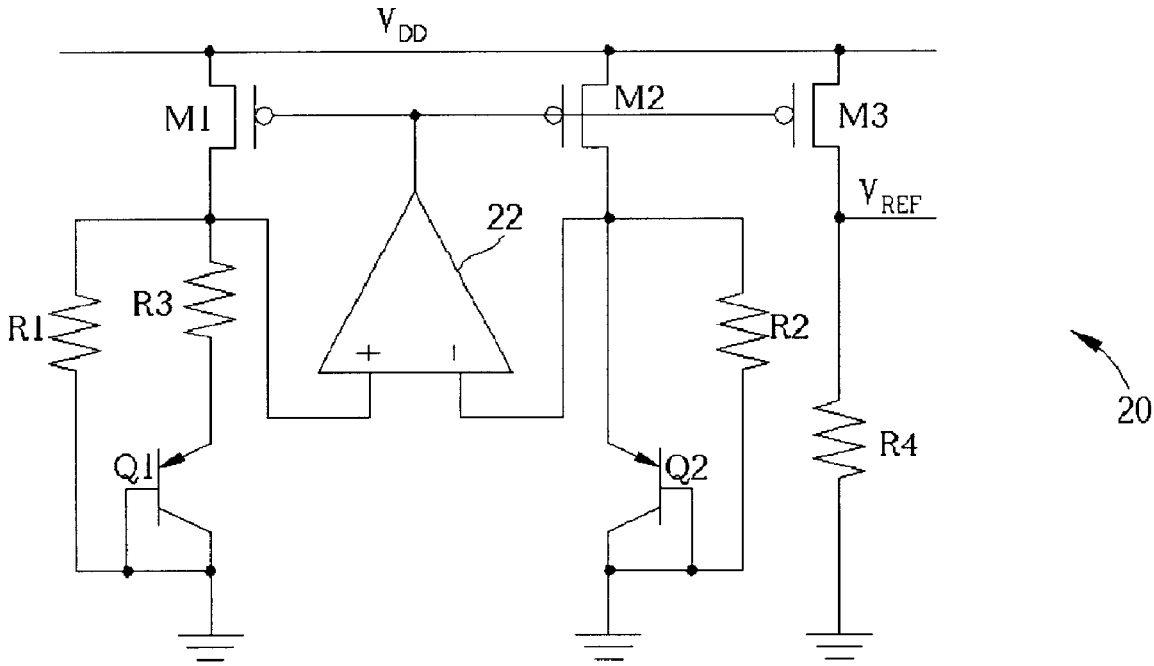
Fig. 2 Prior art
FIG. 2 is a circuit diagram of a conventional low-voltage bandgap reference.
Figure 3:
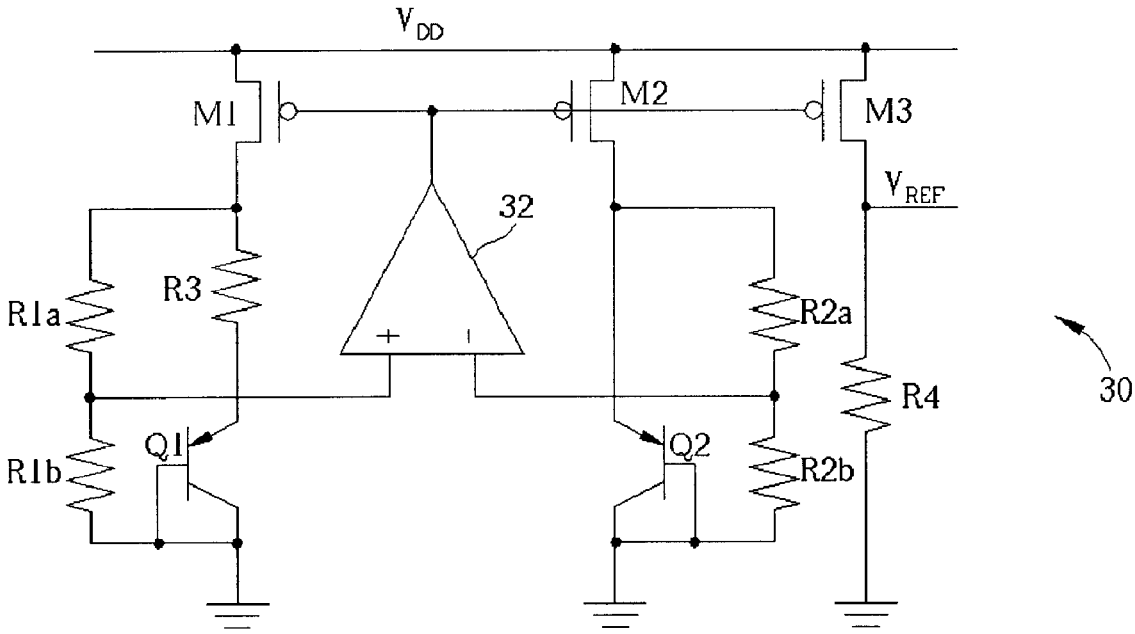
Fig. 3 Prior art
FIG. 3 is a circuit diagram of a conventional low-voltage bandgap reference.
Figure 4:
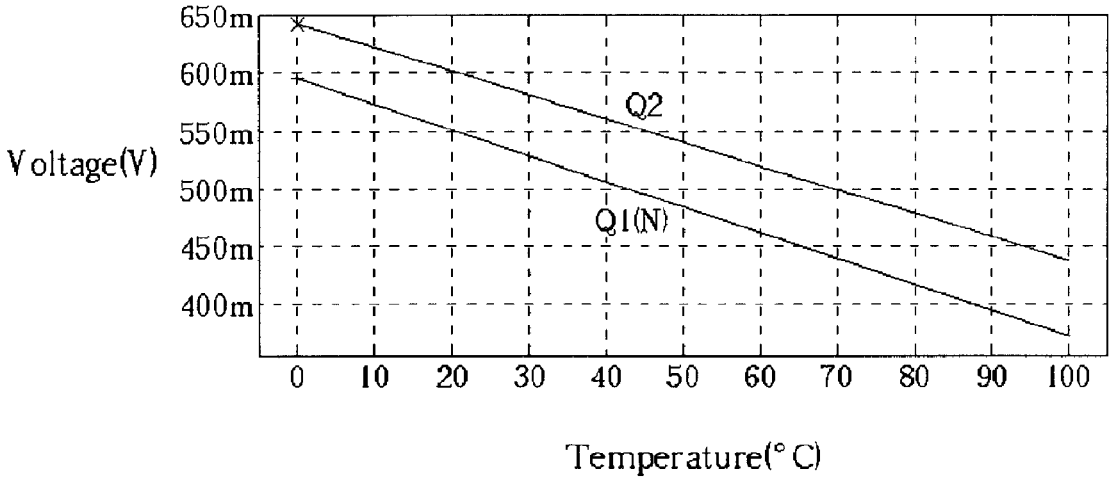
FIG. 4 is a graph of base-emitter voltage versus temperature of two diodes of a bandgap reference.
Figure 5:
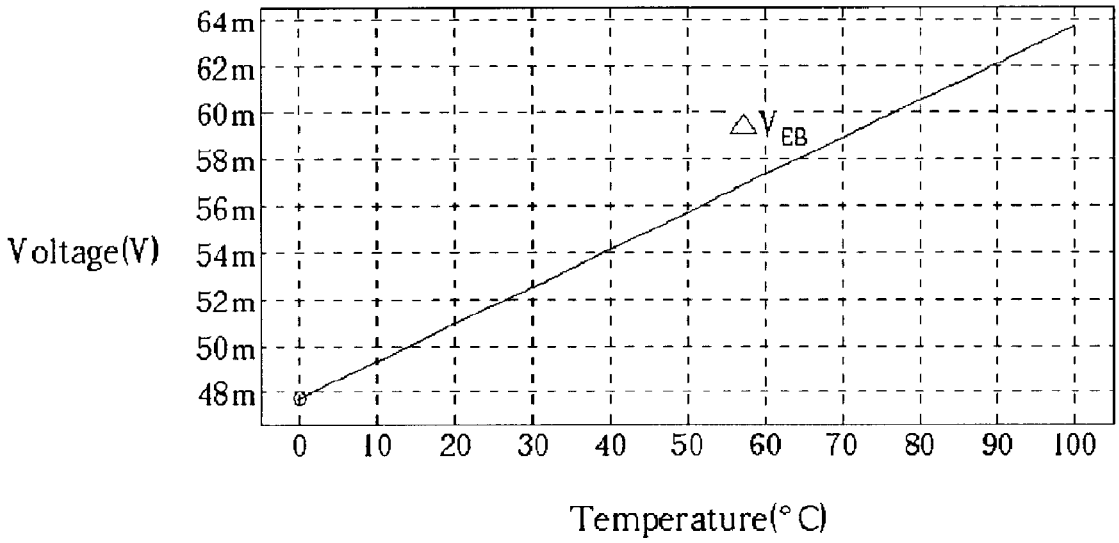
FIG. 5 is a graph of the difference of the diode base-emitter voltages of FIG. 4 versus temperature.

As a basis for the explaining the present invention, please refer to FIG. 4 and FIG. 5. FIG. 4 illustrates base-emitter voltage of two diodes Q1, Q2 (discussed later) with respect to temperature. FIG. 5 illustrates the difference of the diode base-emitter voltages with respect to temperature. It can be seen that the base-emitter voltage, $V_{EB}$, has a negative temperature coefficient of about −2 mV/° C. with $V_{EB}$=0.55 V and T=300 K. The difference of the diode base-emitter voltages, $\Delta V_{EB}$, with respect to temperature, as shown in FIG. 5, is used in the present invention to produce a PTAT to eliminate the effect of the negative temperature coefficient.

Figure 6:
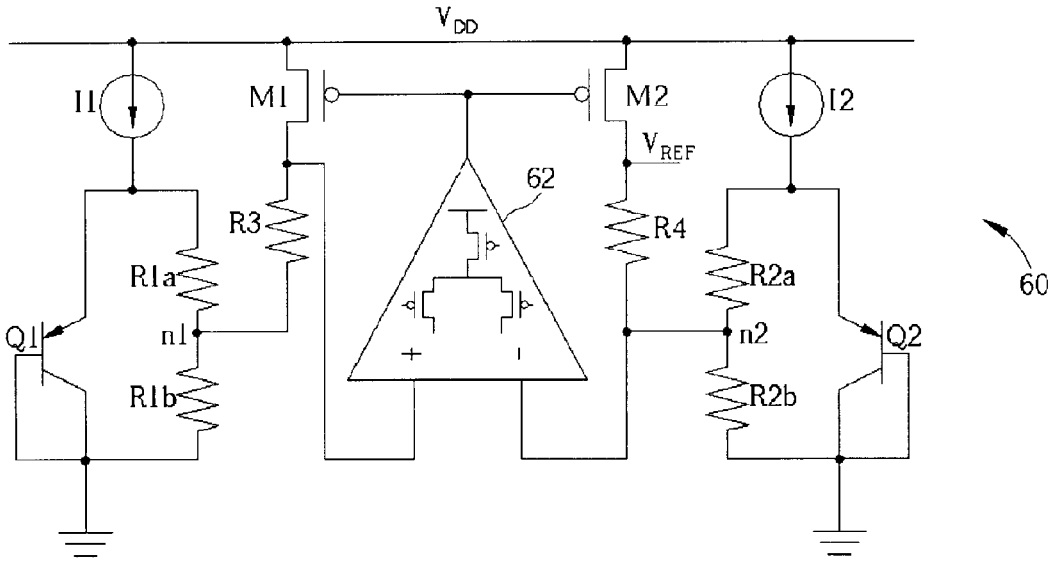
FIG. 6 is a circuit diagram of a first embodiment of the present invention bandgap reference.

Please refer to FIG. 6 which illustrates a circuit diagram of a bandgap reference circuit 60 according to a first embodiment of the present invention. The circuit 60 is a CMOS circuit and includes a p-channel operational amplifier 62, and a first PNP transistor M1 having a source connected to a positive voltage $V_{DD}$ and a drain connected to the positive input end of the amplifier 62. The drain of the transistor M1 is further connected to a first node n1 through a first resistor R3. A second PNP transistor M2 has a source connected to the voltage $V_{DD}$ and a drain connected to a second node n2 through a second resistor R4. The gate of the transistor M2 is connected to the gate of the transistor M1, the gates of the transistors M1, M2 both being connected to the output of the operational amplifier 62. The second node n2 is connected to the negative input end of the amplifier 62. The circuit 60 further includes a third resistor R1*a* and a fourth resistor R1*b* connected in series at the first node n1. The resistors R1*a*, R1*b* are connected in parallel with a first bipolar PNP diode Q1, which has a collector and a base connected to ground and an emitter connected to the current source I1. Finally, the circuit 60 includes a fifth resistor R2*a* and a sixth resistor R2*b* connected in series at the second node n2. The fifth and sixth resistors R2*a*, R2*b* are connected in parallel with a second diode Q2, which has a collector and a base connected to ground and an emitter connected to the current source I2.

Figure 7:
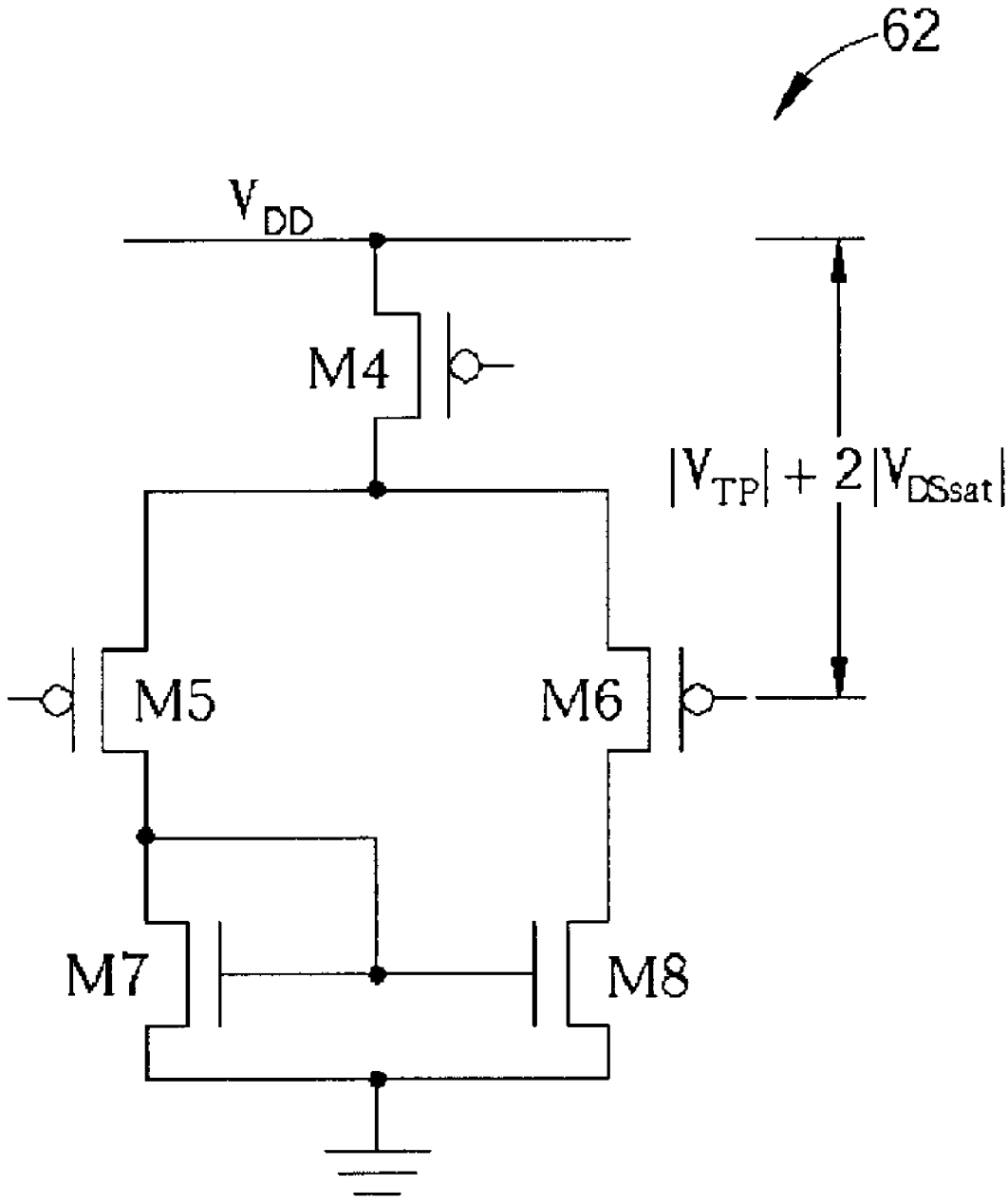
FIG. 7 is a circuit diagram of an operational amplifier used in the bandgap reference of FIG. 6.

FIG. 7 illustrates one possible circuit for the p-channel operational amplifier 62. The operational amplifier 62 comprises a third PNP transistor M4 having a source connected to the voltage $V_{DD}$ and a drain connected to sources of fourth and fifth PNP transistors M5, M6. The drains of the transistors M5, M6 are respectively connected to drains of sixth and seventh NPN transistors M7, M8. The NPN transistors M7, M8 have sources grounded and gates mutually connected and also connected with the drain of the transistor M7.

Given the amplifier 62, the minimum supply voltage is ex-pressed as:

$$V_{DD(min)}=V_{IN(max)}+|V_{TP}|+2\cdot|V_{DSsat}| \tag{7}$$

where the voltages $V_{TP}$ and $V_{DSsat}$ are as illustrated in FIG. 7. Thus, the reference voltage, $V_{REF}$, of the present invention bandgap reference circuit 60 is:

$$V_{REF}=\frac{R_{1b}}{R_{1a}+R_{1b}}\left[\left(R_4+\frac{R_{1a}R_{1b}}{R_{1a}+R_{1b}}\right)\frac{\Delta V_{EB}}{R_3}+V_{EB2}\right], \tag{8}$$

where:

$R_{1a}$, $R_{1b}$, $R_3$, and $R_4$ are the resistances of the resistors R1*a*, R1*b*, R3, and R4, respectively, $\Delta V_{EB}$ is the emitter-base voltage difference between the diodes Q1 and Q2, and $V_{EB2}$ is the emitter-base voltage of the diode Q2.

And finally, the minimum supply voltage of the bandgap reference is effectively reduced as described by combining (7) and (8) such that:

$$V_{DD(\min)}=\frac{R_{1b}}{R_{1a}+R_{1b}}\left(V_{EB2}+\frac{R_{1a}}{R_3}\frac{R_{1b}}{R_{1a}+R_{1b}}\Delta V_{EB}\right)+|V_{TP}|+2\cdot|V_{DSsat}| \tag{9}$$

Figure 10:
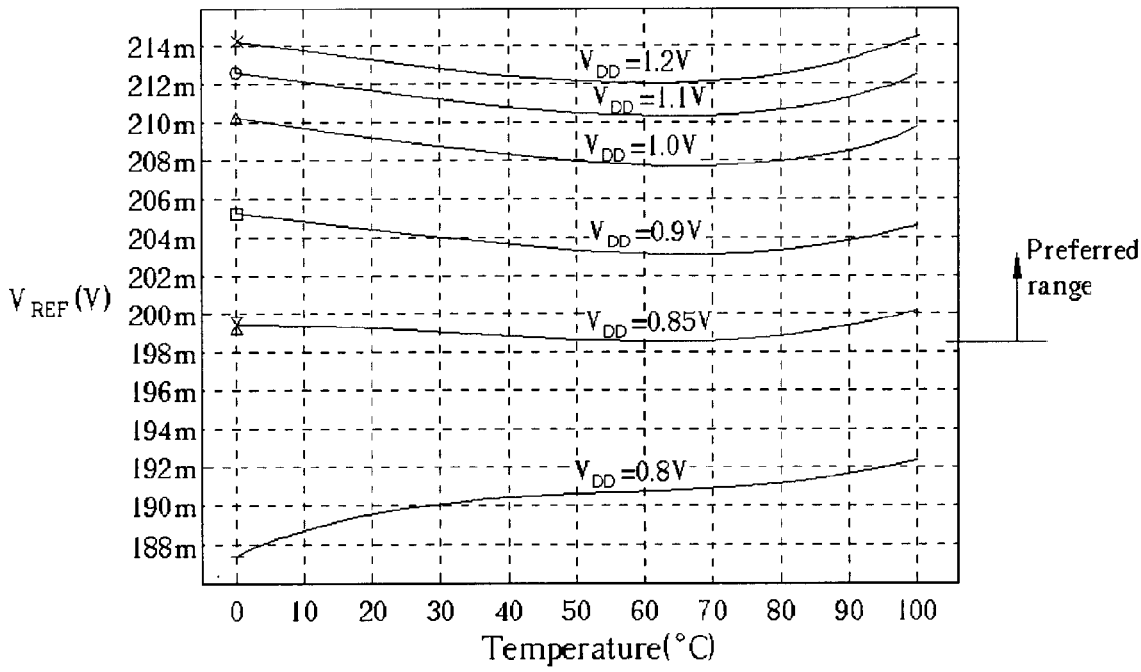
FIG. 10 is a graph of reference voltage versus temperature showing lines of constant supply voltage for the bandgap reference of FIG. 6.
Figure 11:
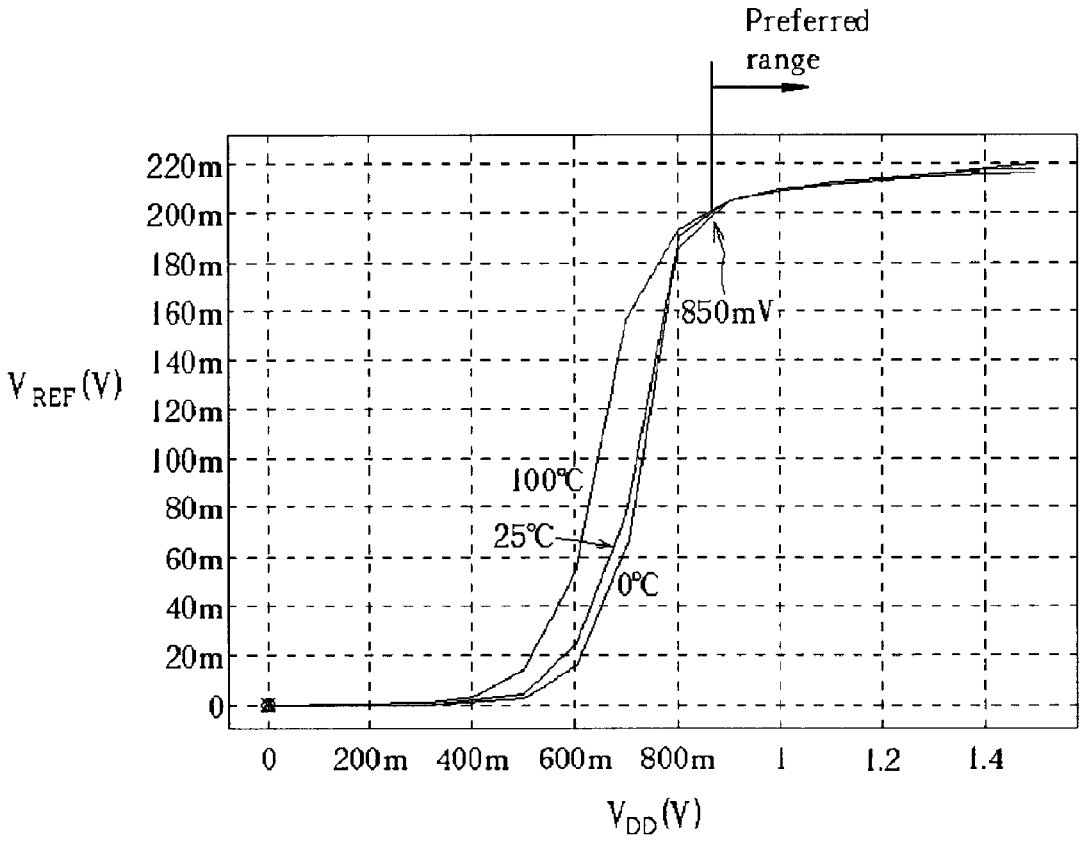
FIG. 11 is a graph of reference voltage versus supply voltage showing lines of constant temperature for the bandgap reference of FIG. 6.

Simulation results for the bandgap reference are as shown in FIG. 10 and FIG. 11. FIG. 10 shows reference voltage, $V_{REF}$, versus temperature showing lines of constant supply voltage, $V_{DD}$; while FIG. 11 shows reference voltage, $V_{REF}$, versus supply voltage, $V_{DD}$, showing lines of constant temperature. In view of these results the preferred operating supply voltage, $V_{DD}$, of the bandgap reference 60 is greater than about 0.85 V, that is, where the reference voltage is least sensitive to temperature. For other embodiments, the preferred supply voltage may be different.

In normal operation of the bandgap reference circuit 60, the voltage $V_{DD}$ is set to about 0.85 V, a temperature-insensitive reference voltage, $V_{REF}$, of about 200 mV with an effective temperature coefficient of 58.1 ppm/° C. is output at the drain of the transistor M2.

Figure 8:
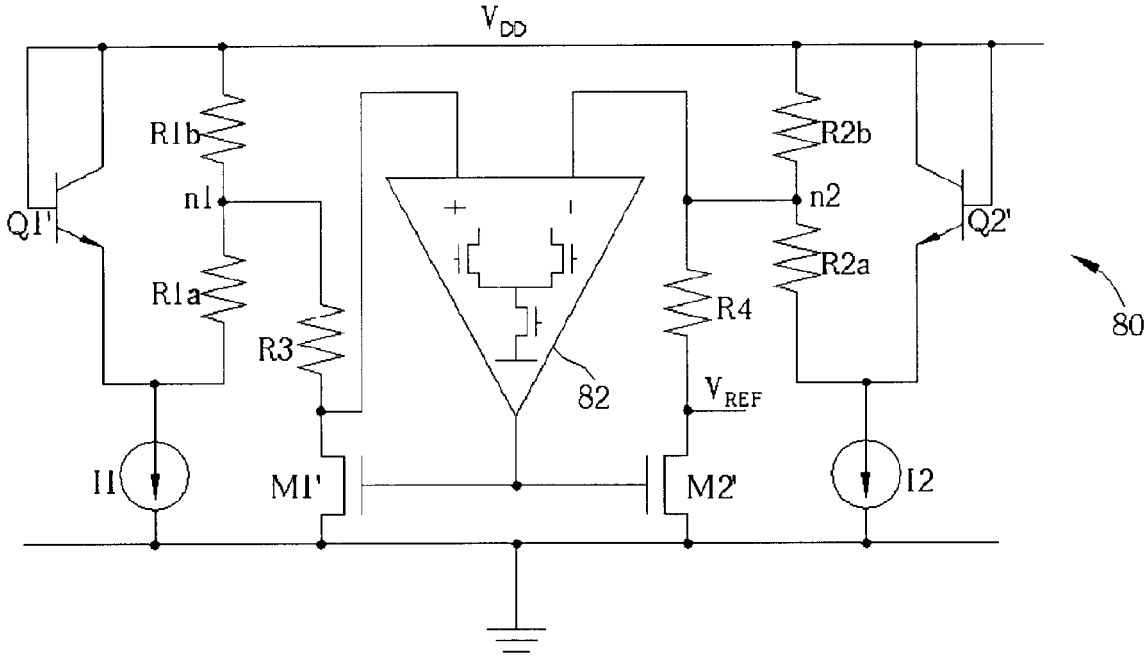
FIG. 8 is a circuit diagram of a second embodiment of the present invention bandgap reference.

A second embodiment of the present invention is illustrated in FIG. 8, which shows a bandgap reference circuit 80. The second embodiment circuit 80 is an NMOS version of the first embodiment circuit 60. Compared to the circuit 60, like reference numerals indicate like components, with primed reference numerals indicating NPN rather than PNP or PNP rather than NPN. The circuit 80 is a CMOS circuit and includes an n-channel operational amplifier 82, and a first NPN transistor M1 which has a source connected to ground and a drain connected to the positive input end of the amplifier 82. The drain of the transistor M1 is also connected to the first node n1 through the first resistor R3. A second NPN transistor M2 has a source connected to ground and a drain connected to the node n2 through the second resistor R4. The node n2 is connected to the negative input end of the operational amplifier 82. Gates of the transistors M1, M2" are mutually connected and further connected to the output of the operational amplifier 82. The third resistor R1*a* and the fourth resistor R1*b* are connected in series at the node n1. The resistors R1*a*, R1*b* are also connected in parallel with the a diode Q1 between the first current source I1 and voltage $V_{DD}$. The diode Q1 is a bipolar NPN transistor having its collector and base connected to voltage V DD and its emitter connected to the current source I1. The fifth and sixth resistors R2*a*, R2*b* are connected in series at the node n2. The resistors R2*a*, R2*b* are also connected in parallel with a diode Q2 between a second current source I2 and the voltage $V_{DD}$. The diode Q2 is a bipolar NPN transistor having its collector and base connected to voltage $V_{DD}$ and its emitter connected to the current source I2.

Figure 9:
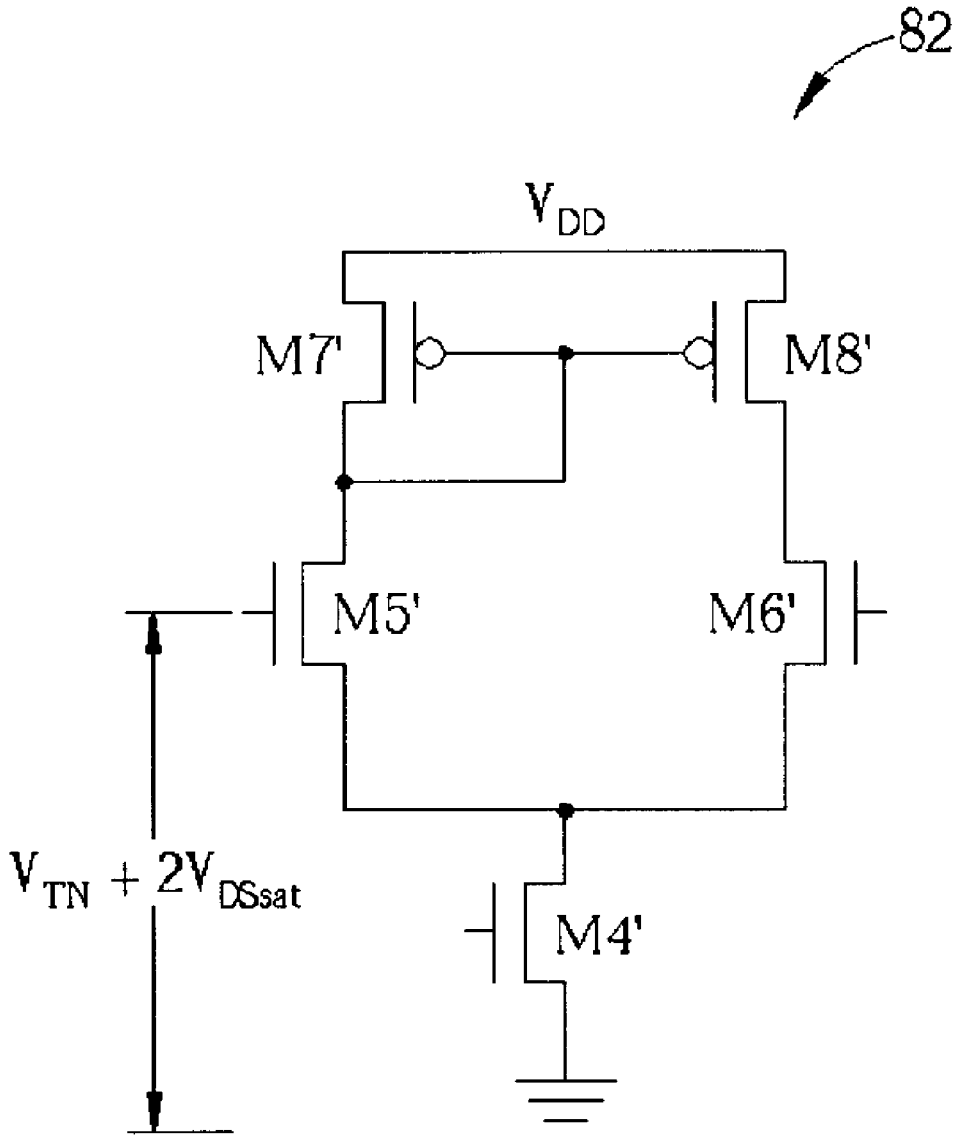
FIG. 9 is a circuit diagram of an operational amplifier used in the bandgap reference of FIG. 8.

FIG. 9 illustrates one possible circuit for the n-channel operational amplifier 82. The amplifier 82 includes an NPN transistor M4 having a source grounded and a drain connected to sources of NPN transistors M5, M6. The drains of the transistors M5, M6 are respectively connected to drains of PNP transistors M7, M8. The transistors M7, M8 have sources connected to the voltage $V_{DD}$ and gates mutually connected and connected to the source of the PNP transistor M7.

In the bandgap reference circuit 80, the minimum input voltage, $V_{IN(min)}$, of the amplifier 82 is according to:

$$V_{IN(min)}=V_{IN}+2V_{DSsat} \tag{10}$$

where $V_{TP}$ and $V_{DSsat}$ are as illustrated in FIG. 9.

Operation and output of the bandgap reference 80 are similar to those of the bandgap reference 60. One significant difference between the two present invention bandgap references 60, 80 is in the power supply rejection ratio (PSRR). The PNP bandgap reference 60 has a strong rejection to the positive supply, while the NPN bandgap reference 80 has a strong rejection to the negative supply. Furthermore, the NPN bandgap reference 80 has a reduced susceptibility to ground fluctuations.

While the bandgap reference circuits 60, 80 were previously described as CMOS circuits, there is no reason why they cannot be implemented with other technologies such as with discrete components, BiCMOS, or emerging semiconductor processes. Furthermore, suitable combinations, where a mix of component types are used, of current or new technologies can also be used to realize the present invention.

In contrast to the prior art, the present invention provides a temperature insensitive reference voltage of less than 1 V with a circuit compatible with CMOS technology.

Those skilled in the art will readily observe that numerous modifications and alterations of the device may be made while retaining the teachings of the invention. Accordingly, the above disclosure should be construed as limited only be the metes and bounds of the appended claims.

What is claimed is:

1. A bandgap reference circuit comprising:

an operational amplifier (62, 82) having a positive input end, a negative input end, and an output end;

a first transistor (M1, M1) having a source connected to a first voltage and a drain connected to the positive input end and separately to a first node (n1) through a first resistor (R3);

a second transistor (M2, M2) having a source connected to the first voltage and a drain connected to a second node (n2) through a second resistor (R4), the second node (n2) being connected to the negative input end; a gate of the second transistor (M2, M2) connected to a gate of the first transistor (M1, M1) and the output of the operational amplifier (62, 82);

a third resistor (R1*a*) and a fourth resistor (R1*b*) connected in series at the first node (n1), the third and fourth resistors (R1*a*, R1*b*) connected in parallel with a first diode (Q1, Q1) between a first current source (I1) and a second voltage; and a fifth resistor (R2*a*) and a sixth resistor (R2*b*) connected in series at the second node (n2), the fifth and sixth resistors (R2*a*, R2*b*) connected in parallel with a second diode (Q2, Q2) between a second current source (I2) and the second voltage.

2. The bandgap reference circuit of claim 1 wherein the first and second transistors (M1, M2) are PNP transistors, the first and second diodes (Q1, Q2) are bipolar PNP transistors having collectors and bases connected to the second voltage that is ground and emitters connected to the first and second current sources (I1, I2) respectively, and the first voltage is significantly higher than ground.

3. The bandgap reference circuit of claim 2 wherein the operational amplifier (62) comprises a third PNP transistor (M4) having a source connected to the first voltage and a drain connected to sources of fourth and fifth PNP transistors (M5, M6), drains of the fourth and fifth PNP transistors (M5, M6) are respectively connected to drains of sixth and seventh NPN transistors (M7, M8), the sixth and seventh NPN transistors (M7, M8) have sources grounded and gates mutually connected and connected to the drain of the sixth NPN transistor (M7).

4. The bandgap reference circuit of claim 3 wherein the first voltage is between 0.85 and 1.2 volts such that an output reference voltage at the drain of the second transistor is between 198 and 214 millivolts.

5. The bandgap reference circuit of claim 1 wherein the first and second transistors (M1, M2) are NPN transistors, the first and second diodes (Q1", Q2) are bipolar NPN transistors having collectors and bases connected to the second voltage set at significantly higher than ground and emitters connected to the first and second current sources (I1, I2) respectively, and the first voltage is ground.

6. The bandgap reference circuit of claim 5 wherein the operational amplifier (82) comprises a third NPN transistor (M4) having a source grounded and a drain connected to sources of fourth and fifth NPN transistors (M5, M6), drains of the fourth and fifth NPN transistors (M5, M6) are respectively connected to drains of sixth and seventh PNP transistors (M7, M8), the sixth and seventh PNP transistors (M7, M8) have sources connected to the second voltage and gates mutually connected and connected to the source of the sixth PNP transistor (M7).

7. The bandgap reference circuit of claim 6 wherein the second voltage is between 0.85 and 1.2 volts such that an output reference voltage at the drain of the second transistor is between 198 and 214 millivolts.

8. A bandgap reference circuit comprising:

an operational amplifier (62) having a positive input end, a negative input end, and an output end;

a first PNP transistor (M1) having a source connected to a first voltage significantly higher than ground and a drain connected to the positive input end and separately to a first node (n1) through a first resistor (R3);

a second PNP transistor (M2) having a source connected to the first voltage and a drain connected to a second node (n2) through a second resistor (R4), the second node (n2) being connected to the negative input end; a gate of the second transistor (M2) connected to a gate of the first transistor (M1) and the output of the operational amplifier (62);

a third resistor (R1*a*) and a fourth resistor (R1*b*) connected in series at the first node (n1), the third and fourth resistors (R1*a*, R1*b*) connected in parallel with a first diode (Q1) between a first current source (I1) and ground; and a fifth resistor (R2*a*) and a sixth resistor (R2*b*) connected in series at the second node (n2), the fifth and sixth resistors (R2*a*, R2*b*) connected in parallel with a second diode (Q2) between a second current source (I2) and ground.

9. The bandgap reference circuit of claim 8 wherein the first and second diodes (Q1, Q2) are bipolar PNP transistors having collectors and bases connected to ground and emitters connected to the first and second current sources (I1, I2) respectively.

10. The bandgap reference circuit of claim 9 wherein the operational amplifier (62) comprises a third PNP transistor (M4) having a source connected to the first voltage and a drain connected to sources of fourth and fifth PNP transistors (M5, M6), drains of the fourth and fifth PNP transistors (M5, M6) are respectively connected to drains of sixth and seventh NPN transistors (M7, M8), the sixth and seventh NPN transistors (M7, M8) have sources grounded and gates mutually connected and connected to the drain of the sixth NPN transistor (M8).

11. The bandgap reference circuit of claim 10 wherein the first voltage is between 0.85 and 1.2 volts such that an output reference voltage at the drain of the second transistor is between 198 and 214 millivolts.

12. A bandgap reference circuit comprising:

an operational amplifier (82) having a positive input end, a negative input end, and an output end;

a first NPN transistor (M1) having a source connected to ground and a drain connected to the positive input end and separately to a first node (n1) through a first resistor (R3);

a second NPN transistor (M2) having a source connected to ground and a drain connected to a second node (n2) through a second resistor (R4), the second node (n2) being connected to the negative input end; a gate of the second transistor (M2) connected to a gate of the first transistor (M1) and the output of the operational amplifier (82);

a third resistor (R1*a*) and a fourth resistor (R1*b*) connected in series at the first node (n1), the third and fourth resistors (R1*a*, R1*b*) connected in parallel with a first diode (Q1) between a first current source (I1) and a second voltage set significantly higher than ground; and a fifth resistor (R2*a*) and a sixth resistor (R2*b*) connected in series at the second node (n2), the fifth and sixth resistors (R2*a*, R2*b*) connected in parallel with a second diode (Q2) between a second current source (I2) and the second voltage.

13. The bandgap reference circuit of claim 12 wherein the first and second diodes (Q1, Q2) are bipolar NPN transistors having collectors and bases connected to the second voltage and emitters connected to the first and second current sources (I1, I2) respectively.

14. The bandgap reference circuit of claim 13 wherein the operational amplifier (82) comprises a third NPN transistor (M4) having a source grounded and a drain connected to sources of fourth and fifth NPN transistors (M5, M6), drains of the fourth and fifth NPN transistors (M5, M6) are respectively connected to drains of sixth and seventh transistors (M7, M8), the sixth and seventh PNP transistors (M7, M8) have sources connected to the second voltage and gates mutually connected and connected to the source of the sixth PNP transistor (M7).

15. The bandgap reference circuit of claim 14 wherein the second voltage is between 0.85 and 1.2 volts such that an output reference voltage at the drain of the second transistor is between 198 and 214 millivolts.

* * * * *